US006591644B2

(12) United States Patent
Doerr et al.

(10) Patent No.: US 6,591,644 B2
(45) **Date of Patent: *Jul. 15, 2003**

(54) BALL BEARING CYLINDER PLUG AND KEY RETENTION

(75) Inventors: Alan Doerr, Tomball, TX (US); Pete Kajuch, Brookfield, WI (US); Cheryl Kay Koskela, Santa Rosa, CA (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/765,998

(22) Filed: Jan. 19, 2001

(65) Prior Publication Data

US 2002/0095961 A1 Jul. 25, 2002

(51) Int. Cl.[7] ..... E05B 47/06

(52) U.S. Cl. ..... 70/278.3; 70/278.7; 70/283.1; 70/495

(58) Field of Search ..... 70/278.2, 278.3, 70/389, 495, 278.7, 277, 279.1, 283, 283.1

(56) References Cited

U.S. PATENT DOCUMENTS

| | | | | | |
|---|---|---|---|---|---|
| 3,418,833 | A | * | 12/1968 | Kerr | 70/389 |
| 3,509,748 | A | * | 5/1970 | Trainor | 70/389 |
| 3,575,024 | A | * | 4/1971 | Schlage | 70/389 |
| 4,312,198 | A | | 1/1982 | Sedley | 70/276 |
| 4,366,688 | A | | 1/1983 | Bennett | 70/395 |
| 4,440,011 | A | | 4/1984 | Klein | 70/438 |
| 4,516,416 | A | * | 5/1985 | Prunbauer et al. | 70/386 X |
| 4,562,712 | A | | 1/1986 | Wolter | 70/456 R |
| 4,663,952 | A | | 5/1987 | Gelhard | 70/408 X |
| 4,789,859 | A | * | 12/1988 | Clarkson et al. | 361/172 X |
| 4,868,409 | A | | 9/1989 | Tanaka et al. | 307/10.5 |
| 5,003,801 | A | | 4/1991 | Stinar et al. | 70/408 X |
| 5,010,750 | A | | 4/1991 | Böser et al. | 70/276 |
| 5,091,771 | A | | 2/1992 | Bolan et al. | 357/74 |
| 5,156,032 | A | | 10/1992 | Edgar | 70/395 X |
| 5,255,547 | A | | 10/1993 | Burr et al. | 70/252 |
| 5,281,945 | A | | 1/1994 | Keppner et al. | 345/146.2 |
| 5,311,757 | A | | 5/1994 | Spahn | 70/408 |
| 5,361,614 | A | * | 11/1994 | Metcalf | 70/389 |
| 5,367,295 | A | | 11/1994 | Gokcebay et al. | 235/382 X |
| 5,433,096 | A | | 7/1995 | Janssen et al. | 70/395 X |
| 5,435,160 | A | | 7/1995 | Linsalato et al. | 70/408 |
| 5,437,174 | A | | 8/1995 | Aydin | 70/280 X |
| 5,469,727 | A | * | 11/1995 | Spahn et al. | 70/278.3 |
| 5,507,162 | A | * | 4/1996 | Chhatwal | 70/278.3 |
| 5,541,581 | A | | 7/1996 | Trent | 70/283 X |
| 5,542,274 | A | | 8/1996 | Thordmark et al. | 70/495 |
| 5,552,777 | A | | 9/1996 | Gokcebay et al. | 361/172 X |
| 5,689,985 | A | | 11/1997 | Chamberlain | 70/438 |
| 5,823,030 | A | * | 10/1998 | Theriault et al. | 70/389 X |
| 5,836,187 | A | * | 11/1998 | Janssen et al. | 70/278.3 X |
| 6,442,986 | B1 | * | 9/2002 | Russell et al. | 70/278.3 |

FOREIGN PATENT DOCUMENTS

| | | | | |
|---|---|---|---|---|
| DE | 41 41 270 A 1 | | 6/1993 | |
| FR | 2518618 A1 | * | 6/1983 | 70/278.2 |
| GB | 2 039 321 A | | 8/1980 | |
| GB | 2 263 302 A | | 7/1993 | |

* cited by examiner

*Primary Examiner*—Lloyd A. Gall
(74) *Attorney, Agent, or Firm*—Michael Best & Friedrich LLP

(57) ABSTRACT

The invention is directed at an electronic lock assembly which is operable by a suitably programmed electronic key. The electronic lock assembly includes a cylinder type locking mechanism, where a solenoid and plunger is provided to electronically lock and unlock a key cylinder, thereby selectively allowing rotation of the key cylinder for operation of the locking mechanism. To prevent rotation of the key cylinder and loading of the solenoid plunger prior to the solenoid receiving an authorized signal to retract the plunger, a stop mechanism is provided which only allows rotation of the key cylinder in predetermined coordination with operation of the solenoid.

19 Claims, 7 Drawing Sheets

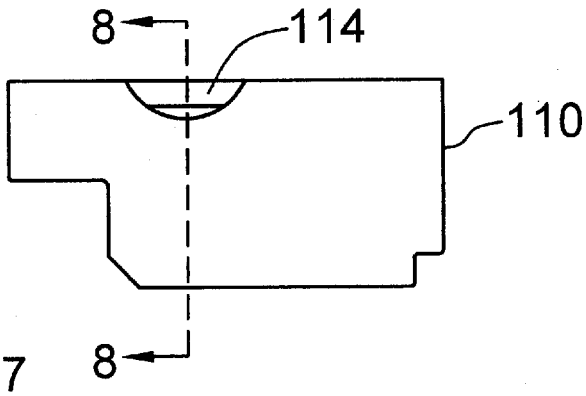
FIG. 7
FIG. 8
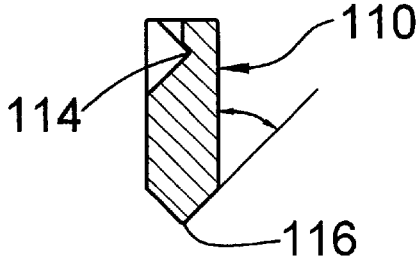
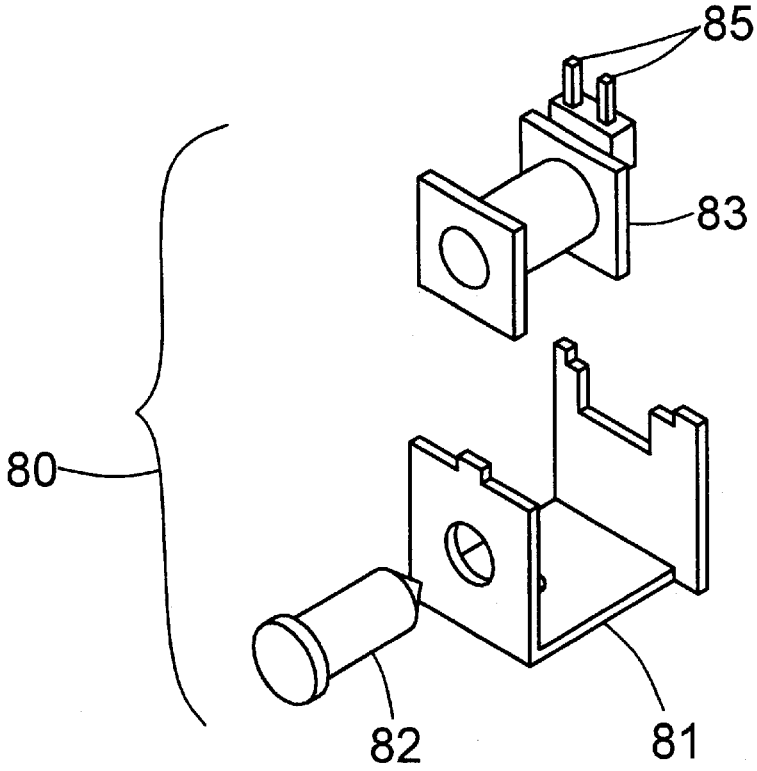
FIG. 6

BALL BEARING CYLINDER PLUG AND KEY RETENTION

TECHNICAL FIELD

This invention relates to an electronic lock assembly which is operated by inserting of an authorized electronic key. Rotation of the lock cylinder is inhibited until operation of the lock assembly is desired. Once the key is rotated, the key cannot be removed from the lock cylinder until the lock cylinder is rotated back to its original position, thereby giving the electronic lock the feel of a mechanical lock.

BACKGROUND OF THE INVENTION

In many environments, such as apartment houses, multi-family dwellings, condominiums or the like, the transient nature of residents present problems in using conventional locking mechanisms in association with a door having a latch which is operable from both sides of the door by means of a handle or the like. In such environments, keys usable to unlock conventional lockable latching mechanisms are easily replicated, thereby potentially compromising the security provided by the lockable latching mechanism. As tenants or occupants move from such an environment, a key or copy of the key can be retained, though the former tenant or occupant is no longer entitled to access thereto. Similarly, if maintenance or repair procedures require access by other personnel, maintaining security may again be compromised if keys are duplicated or not returned by the repair or maintenance personnel. Thus, security standards in such environments may require that the lock be removed in its entirety and replaced, or the lockable latching mechanism is swapped with another mechanism from another unit to ensure security. Another alternative is to have the lockable latching mechanism re-keyed such that the previous key will not operate the mechanism. In each of these situations, the replacement, re-keying or swapping of the lockable latching mechanism is costly, both in terms of expense and/or personnel resources, and/or presents a time consuming and inefficient process for ensuring security.

Attempts have therefore been made to provide enhanced security by providing an electronic lock which employs a programmable processor which can be programmed to only allow operation of the lock if a valid key is used. Thus, upon a tenant or occupant leaving a premises, the electronic lock can simply be reprogrammed so that the old key will not operate the lock, thereby eliminating the need to replace or re-key the lock. Although electronic locks using card readers, key pads or contact activated data ports are known, various deficiencies in such electronic lock assemblies have been found, and such systems have generally been cost prohibitive or complex, thereby limiting widespread use in such environments.

SUMMARY OF INVENTION

Based upon the foregoing, the present invention is directed at an electronic lock assembly which is operable by a suitably programmed electronic key. The electronic lock assembly includes a cylinder type locking mechanism, where a solenoid and plunger is provided to electronically lock and unlock a key cylinder, thereby selectively allowing rotation of the key cylinder for operation of the locking mechanism. To prevent rotation of the key cylinder and loading of the solenoid plunger prior to the solenoid receiving an authorized signal to retract the plunger, a stop mechanism is provided which only allows rotation of the key cylinder in predetermined coordination with operation of the solenoid.

These and other aspects of the invention will become apparent from the following detailed description of the invention when considered in conjunction with the accompanying drawings.

BRIEF DESCRIPTION OF THE DRAWINGS

FIG. 6 is an exploded view of the solenoid and plunger according to this embodiment;

FIG. 7 is a side elevational view of a sidebar according to this embodiment;

FIG. 8 is a cross sectional view taken along line 8—8 in FIG. 7;

DETAILED DESCRIPTION OF THE INVENTION

Figure 1:
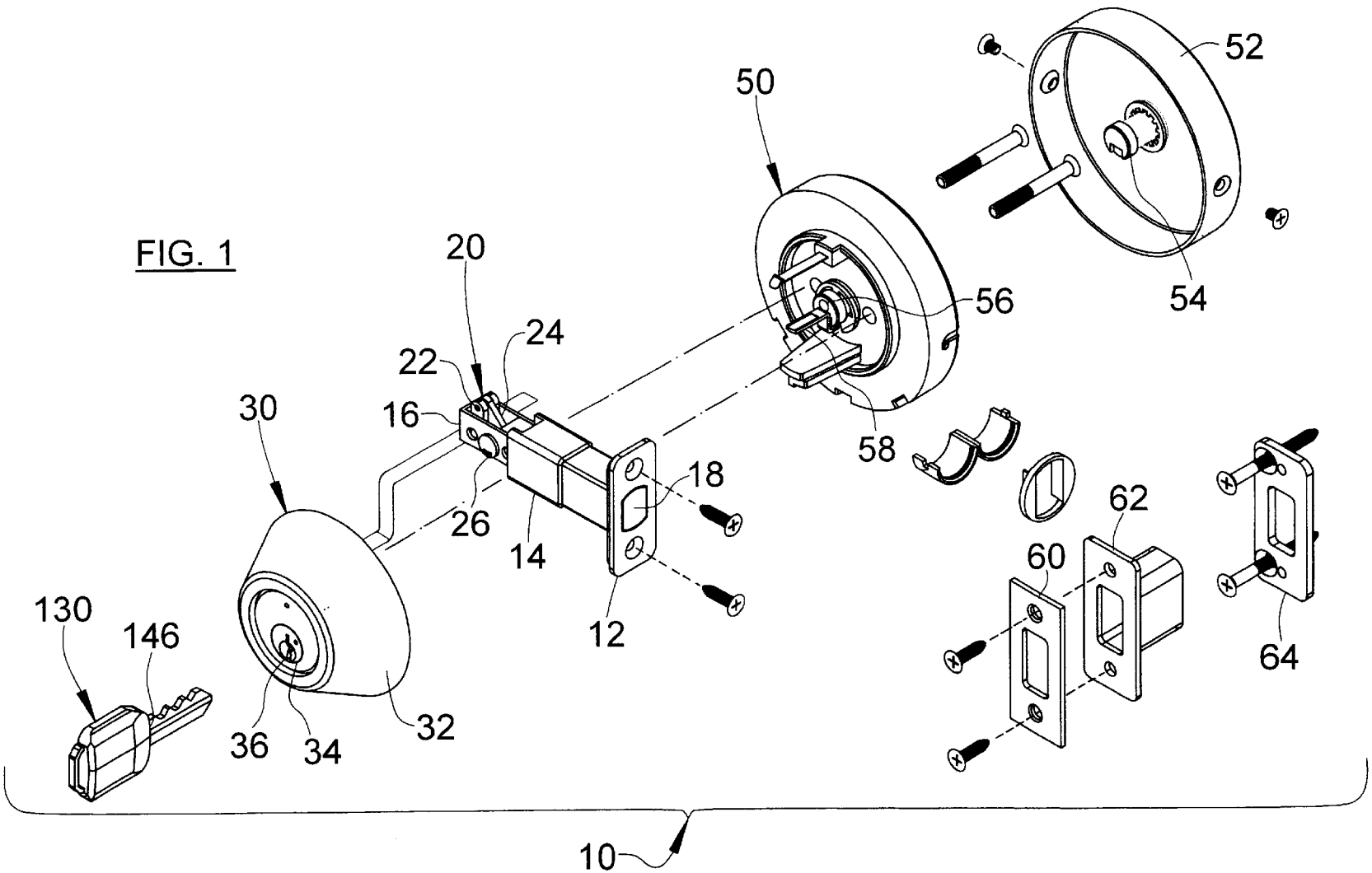
FIG. 1 is a perspective exploded schematic view showing an electronic deadbolt locking mechanism according to an embodiment of the invention.

Turning now to FIG. 1, the present invention will be described in conjunction with an electronic deadbolt assembly. As shown in FIG. 1, the deadbolt assembly may include a face plate 12, which will normally be visible from the edge of the door. A front case 14 may be joined to the front plate 12, and a rear case 16 is provided in telescopic adjustable relationship to the front case 14. A deadbolt 18 is provided in slideable relationship within the front case 14, and is coupled to a swivel generally indicated at 20. The swivel mechanism 20 may include a pair of ears 22 connected to a link 24. The link 24 is connected to the bolt 18 in a suitable fashion, and operation of the deadbolt 18 between a fully extended position and a retracted position is provided by means of a spindle 26 in a known fashion. In general, spindle 26 is engaged between inner and outer cylinders, wherein upon rotation of the cylinders, spindle 26 rotates to cause corresponding movement of the swivel 22 and link 24 and movement of bolt 18 between extended and retracted positions. The structures of the front case 14, rear case 16 and operation of the deadbolt is typical, and details of this construction and operation may be modified in accordance with known mechanisms.

The deadbolt assembly 10 as shown in FIG. 1 further comprising an outside housing assembly 30, which includes an outside rose 32 and a lock cylinder or cylinder plug 34, which will be described in more detail hereafter. The cylinder plug 34 includes a keyway 36, into which an electronic key 130 is inserted for operation of the deadbolt assembly 10. The deadbolt assembly 10 further comprises an inside turn assembly generally designated 50, over which an inside rose 52 is positioned. A thumbturn 54 is coupled to inside turn assembly 50 such that operation of the thumbturn 54 will in turn cause rotation of the thumbturn extension 56 rotating, in turn, an outwardly extending portion 58 which engages spindle 26 in the deadbolt assembly. Thus, upon rotation of the thumbturn 54 on the interior of the door, rotation of the thumbturn extension 56 will in turn cause rotation of extension 58 so as to operate spindle 26 causing corresponding extension or retraction of the deadbolt 18 in a known fashion. The deadbolt 18 in its extended position engages a strike 60 positioned on the doorjamb, and an associated strike box 62. A strike reinforcer 64 may be provided to enhance the structural integrity and security of the deadbolt latch.

It should be recognized that operation of a thumbturn in conjunction with the inside turn assembly 50 to selectively extend or retract the deadbolt 18 is generally known, and will not be described further.

Figure 2:
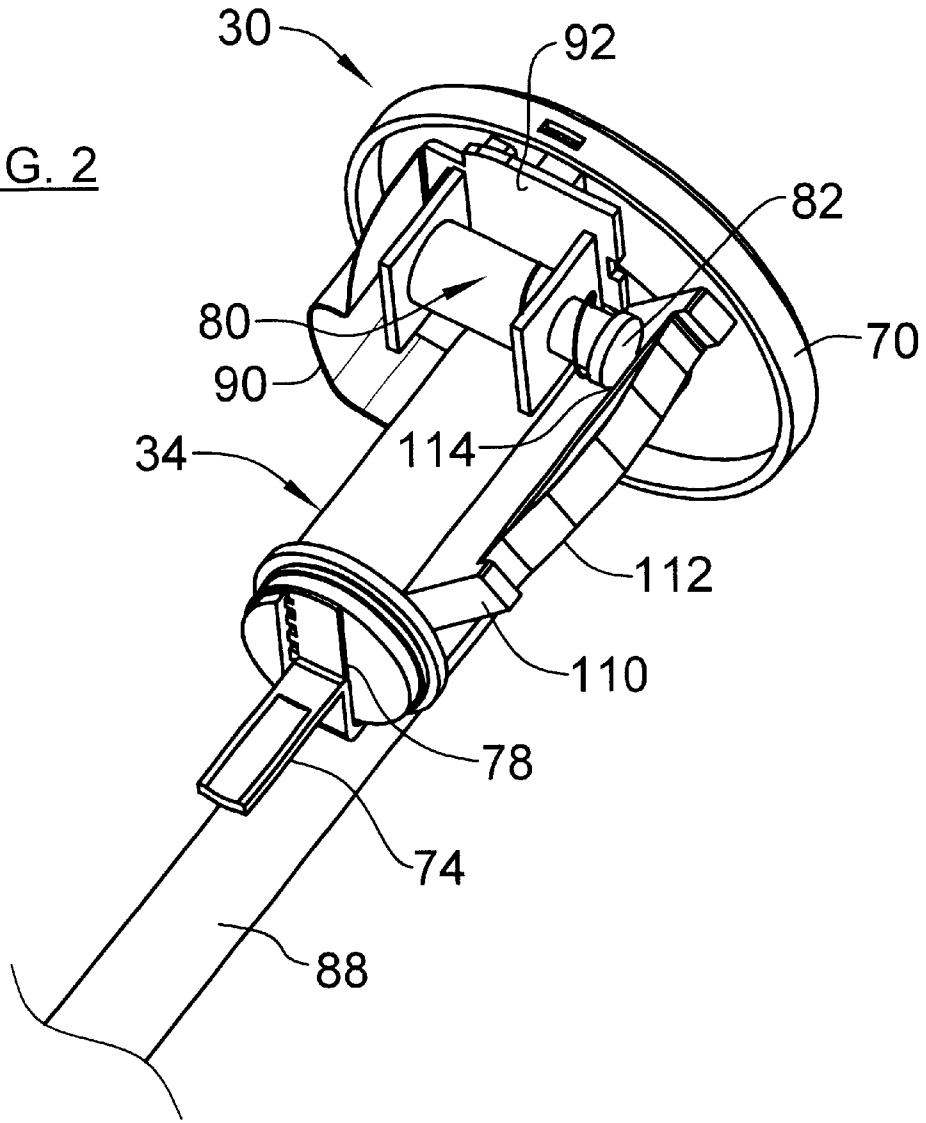
FIG. 2 is a perspective schematic view of a cylinder housing assembly.
Figure 3:
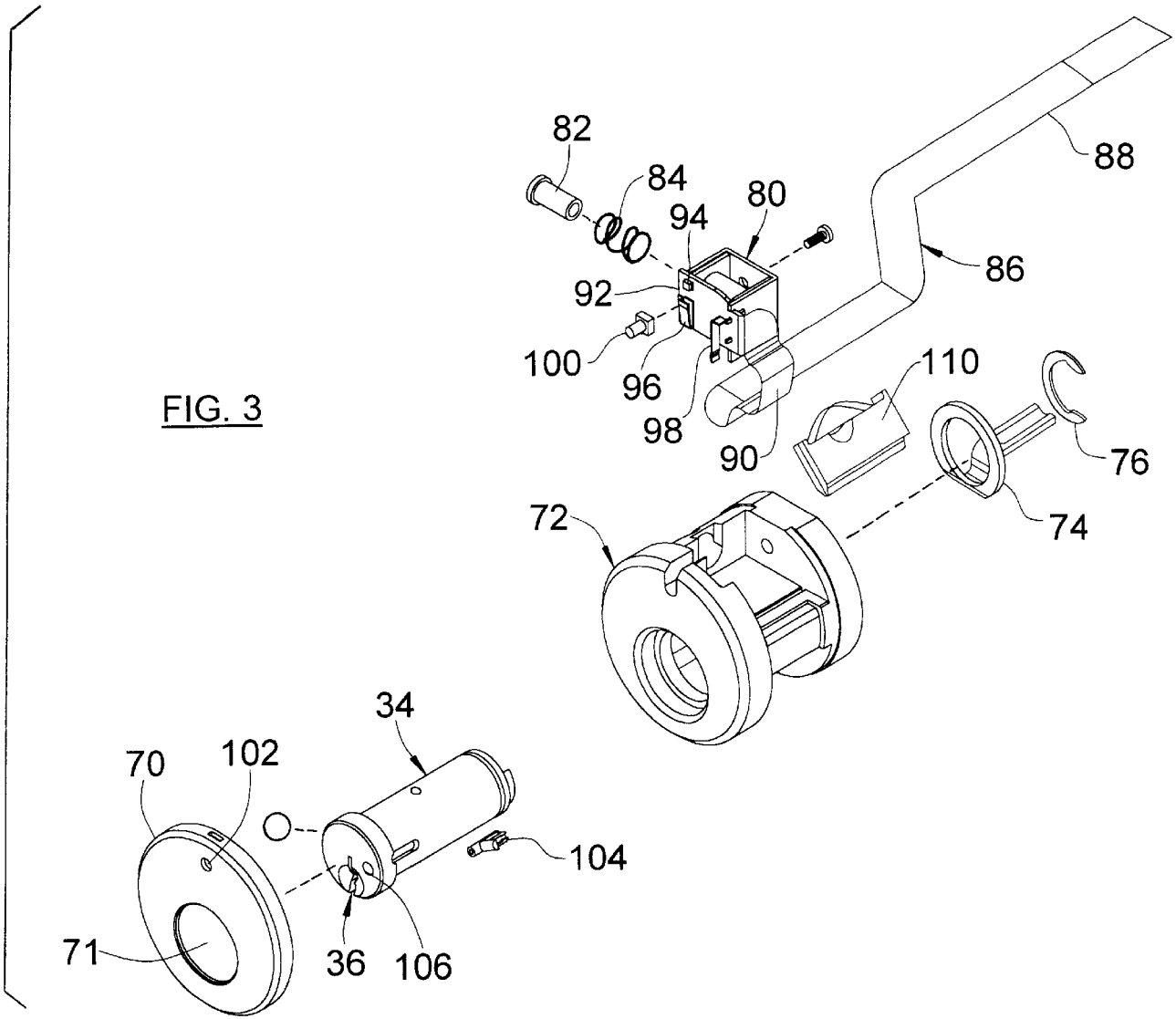
FIG. 3 is an exploded perspective view of the cylinder housing assembly as shown in FIG. 2.

Turning now to FIGS. 2 and 3, the outer housing assembly is shown in more detail. The outside housing assembly 30 includes a cylinder housing cap 70 having a hole 71 through which the cylinder plug 34 is exposed at the outside of the lock assembly. In this manner, keyway 36 will be exposed on the exterior of the lock assembly for access by an electronic key. The cylinder plug 34 is dimensioned to extend within a cylinder outside housing 72, and is selectively rotatable within cylinder outside housing 72 by means of an authorized electronic key positioned within keyway 36. The cylinder outside housing 72 is removed from FIG. 2 for clarity of other elements situated within housing 72. After insertion of the cylinder plug 34 into housing 72, the rearward or opposing end of cylinder plug 34 disposed opposite keyway 36 engages a cylinder tailpiece 74 which is retained thereon by a retaining ring 76. The cylinder tailpiece 74 engages the swivel 26 associated with the deadbolt latch assembly as described in FIG. 1. In this manner, rotation of the cylinder plug 34 will in turn cause rotation of the swivel 26 and extends and retracts the deadbolt 18 as previously described. There also may be provided in association with the rearward end of the cylinder plug 34 a pick cap 78 which helps to prevent picking or tampering with the lock assembly.

Within the outside cylinder housing 72 is positioned a solenoid assembly generally indicated at 80, including a solenoid plunger 82 which is spring biased to an outward position by means of solenoid spring 84. As seen in FIG. 6, the solenoid assembly 80 may comprise a supporting frame 81 in association with a solenoid bobbin 83 to which electrical connection is made via pins 85. The bobbin 83 is inserted and retained therein through an opening in the frame 81. Other suitable configurations to provide solenoid assembly within the lock architecture would be recognized by those of ordinary skill, and are contemplated by the invention. Associated with the solenoid 80 is a flex assembly 86 which includes a flexible electrical connecting interface 88, which carries electrical signals to a microprocessor housed within the inside turn assembly 50 as described with reference to FIG. 1. The flex assembly 86 also couples power to the solenoid 80 from a battery power source housed within inside turn assembly 50 via clip (not shown) positioned at the end of flexible electrical connecting interface 88. An electrical connecting board or stiffener 92 is provided to support various components in conjunction with the flex assembly 86, including an LED 94, a ground clip 96 and a data transfer spring 98. A light pipe 100 is associated with the LED 94 to transmit light from LED 94 to the exterior of the electronic lock through an aperture 102 formed in the cylinder housing cap 70. The LED will provide information to the user, as to whether an authorized key is being used (green indicating light), or whether an unauthorized key has been inserted into the electronic lock assembly (red indicating light) as an example. The LED 94 can be multi-colored to allow various light signaling indications to the user. The ground clip 96 electrically grounds the assembly to the outside cylinder housing 72 when the flex and solenoid assembly is inserted into the outside cylinder housing 72. The data transfer spring 98 extends to be electrically coupled in association with a cylinder pin assembly 104 which is housed in association with the cylinder plug 34. The cylinder pin assembly 104 extends to a position to be accessible at the front face of the cylinder plug 34 when positioned therein, through an access hole 106. Preferably, the cylinder pin assembly 104 extends to be flush with the front face of cylinder plug 34. In operation, when an electronic key is inserted into keyway 36, a contact pin 146 associated with the electronic key contacts the cylinder pin assembly 104 which is in electrical wiper contact with the data transfer spring 98 to communicate data from the electronic key through the flex assembly 86 to the microprocessor. If an authorized key is used, the microprocessor will in turn send a signal through the flex assembly 86 to the solenoid assembly 80 to selectively withdraw the solenoid plunger 82 against the force of bias spring 84.

Figure 4:
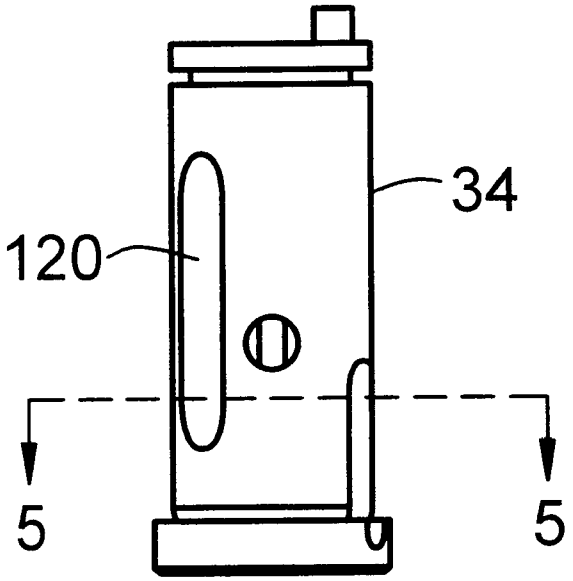
FIG. 4 is a side elevational view of the cylinder plug according to this embodiment.
Figure 5:
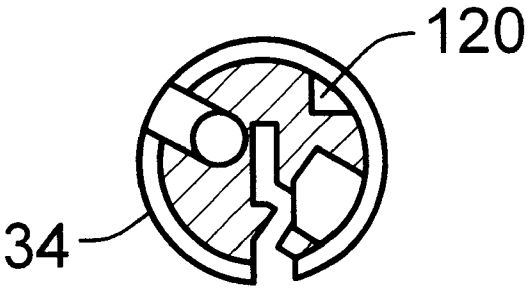
FIG. 5 is a cross sectional view taken along line 5—5 in FIG. 4.

As only an Authorized electronic key will provide data to initiate actuation of the solenoid by the microprocessor, rotation of the cylinder plug is otherwise prevented by a rotation preventing member or sidebar 110. The sidebar 110 includes a sidebar spring 112 which biases the sidebar 110 into engagement with the cylinder plug 34, to prevent rotation of the cylinder plug 34 until actuation of the solenoid and withdrawal of the plunger 82. Sidebar spring 112 may comprise one or more of many types of springs and is not limited to the leaf spring type shown. Although not shown, a pair of coil springs could also be used as the sidebar spring 112. As seen in FIGS. 4 and 5, the cylinder plug 34 includes an elongated slot 120 into which a bottom portion of the sidebar 110 is positioned. As seen in FIG. 8, the bottom portion of the sidebar comprises a contoured point 116, which is substantially matched to engage the slot 120 formed in the plug cylinder 34. As shown in FIG. 8, the contoured point 116 maybe provided with angled portions, which in this embodiment are approximately 45°, to substantially match the configuration of the slot 120, which in this embodiment is formed as an approximate 90° angled slot as seen in FIG. 5. Upon attempting rotation of the cylinder plug 34, and due to the configuration of the slot 120 in association with the bottom portion 116 of the sidebar 110, the sidebar 110 will be urged outwardly from the slot 120 against bias spring 112. To prevent such movement of the sidebar 110 unless an authorized key is inserted into the cylinder plug 34, the plunger 82 of the solenoid engages the slot 114 formed in the side portion of the sidebar 110. As seen in FIG. 8, the slot 114 may also be configured to have angled sides at approximately 45°, into which the plunger 82 is positioned in its normally extended position. When the plunger 82 is positioned within the slot 114, the sidebar 110 is not able to move outwardly relative to the slot 120 formed in the cylinder plug 34. Thus, rotation of the cylinder plug 34 is prevented, thereby effectively locking the deadbolt mechanism, and not allowing retraction of the deadbolt 18 accordingly. When an authorized electronic key is inserted into the cylinder plug 34, and a data signal is generated by a microprocessor to actuate the solenoid 80, the plunger 82 is withdrawn from the slot 114 for a predetermined period of time. As a user rotates the authorized electronic key, the sidebar 110 will be urged out of the slot 120 in the cylinder plug 34 against the force of the bias spring 112, to thereby selectively allow rotation of the cylinder plug and actuation of the deadbolt mechanism to retract the deadbolt 18 and allow opening of the door. After actuation of the deadbolt mechanism by an authorized electronic key, the cylinder plug 34 is rotated back to its initial position, and the sidebar spring 112 urges sidebar 110 back into slot 120 in the cylinder plug 34 and the solenoid plunger 82 into slot 114, to thereby lock rotation of the cylinder plug at the home position until further actuation.

In this embodiment of the invention, upon insertion of an authorized electronic key into the cylinder plug 34, the microprocessor will withdraw the solenoid plunger from the slot 114 for a predetermined amount of time. It may be desirable to provide a short delay occurring between actuation of the solenoid and return of the plunger to its normally extended position. The microprocessor may therefore be programmed to cause retraction of the plunger to accommodate a slight delay which may occur between insertion of an authorized electronic key and the user rotating the cylinder plug 34 for actuation of the deadbolt mechanism. If the user does not rotate the cylinder plug 34 after insertion of an authorized electronic key, the system will time out and the plunger will return to its normally extended position to engage slot 114 and lock the mechanism accordingly.

Figure 10:
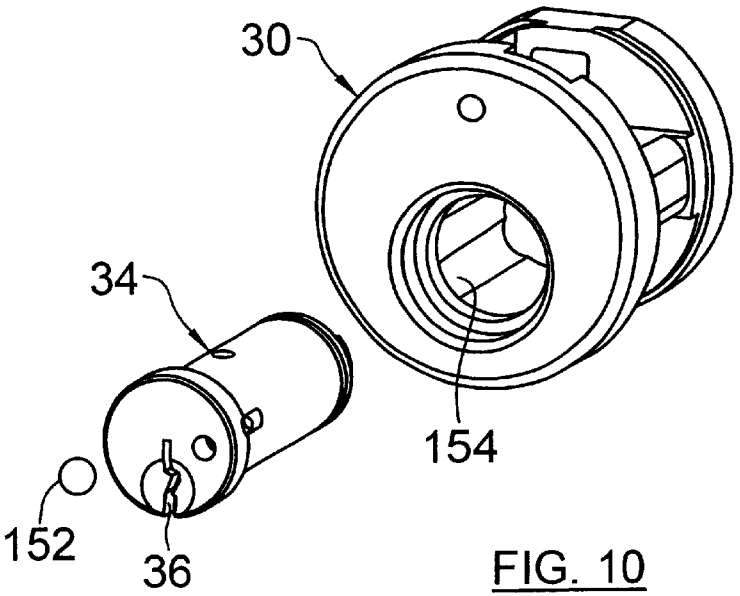
FIG. 10 is an alternate exploded perspective view of the outside housing and cylinder plug as shown in FIG. 9.
Figure 9:
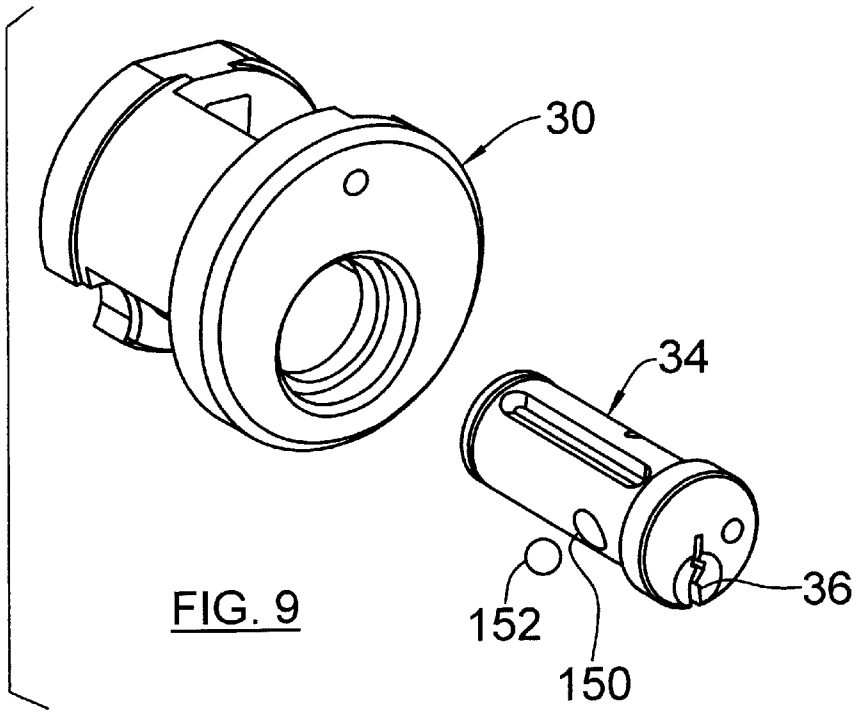
FIG. 9 is an exploded respective view of the outside cylinder housing and cylinder plug according to this embodiment of the invention.
Figure 11:
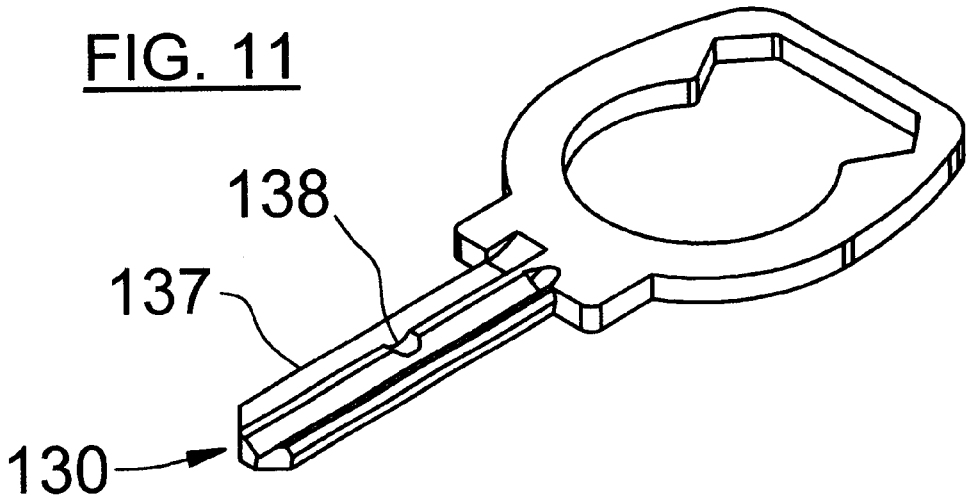
FIG. 11 is a perspective view of an electronic key useable to operate the electronic lock assembly according to the invention.

With respect to the electronic lock assembly as previously described, it is desirable to selectively prevent rotation of the cylinder plug 34 prior to withdraw of the solenoid plunger 82 from its rotation inhibiting position with respect to the cylinder plug 34. In this manner loading of the solenoid plunger 82 prior to the solenoid assembly 80 receiving a signal to retract the plunger 82 is prevented. Proper operation of the lock assembly is thereby facilitated, and no undue forces are applied to these mechanisms which could cause damage or limit the useful life of the mechanism. Turning to FIG. 9 and FIG. 10, an embodiment of a stopped mechanism to accomplish this objective is shown with respect to the outside housing assembly 30 and cylinder plug 34. In this embodiment, the cylinder plug 34 is formed with an opening 150 formed in the cylinder plug 34 to accommodate a ball bearing 152 therein, with ball bearing 152 movable within the opening 150. Referring back to FIG. 5, the opening 150 is seen to extend from an outer surface of the cylinder plug 34 to a position in which a portion of opening 150 intersects with the key way 36 formed in cylinder plug 34. In this manner, upon introduction of the ball bearing 152 into opening 150, a portion of ball bearing 152 can extend into key way 36. As seen in FIG. 10, the outside housing 30 is also formed to include a groove 154, positioned to cooperate with the ball bearing 152 upon assembly of the cylinder plug 34 with housing 30. Upon assembly of the cylinder plug 34 into housing 30 with ball bearing 152 positioned within opening 150, it should be recognized that ball bearing 152 is moveable between an intersecting position with respect to key way 36, and a non-intersecting position when bearing 152 is fully positioned within the groove 154 formed in housing 30. In this manner, upon insertion of an electronic key 130 into key way 36, the key will interact with ball bearing 152 to force bearing 152 into engagement with the groove 154 formed in housing 30. When bearing 152 is forced into engagement with groove 154, rotation of the cylinder plug 34 is inhibited prior to withdrawal of the solenoid plunger 82 from its rotation inhibiting position. As seen in FIG. 11, the electronic key 130 includes an outwardly extending portion 137 which is inserted into the key way 36 in a normal fashion. A slot or dimpled portion 138 is formed within portion 137. Upon full insertion of key 130 into key way 36 the dimple portion 138 mates with the ball bearing 152 to allow movement of ball bearing 152 out of groove 154. In this way, upon full insertion of the key 130 into key way 36, so as to actuate the solenoid assembly 80 and retract solenoid plunger 82 as previously described, the ball bearing 152 will be relieved from a outwardly bias position created by interference from key 130 by means of the dimpled portion 138 to allow rotation of the cylinder plug 34 to operate the lock mechanism.

Figure 12:
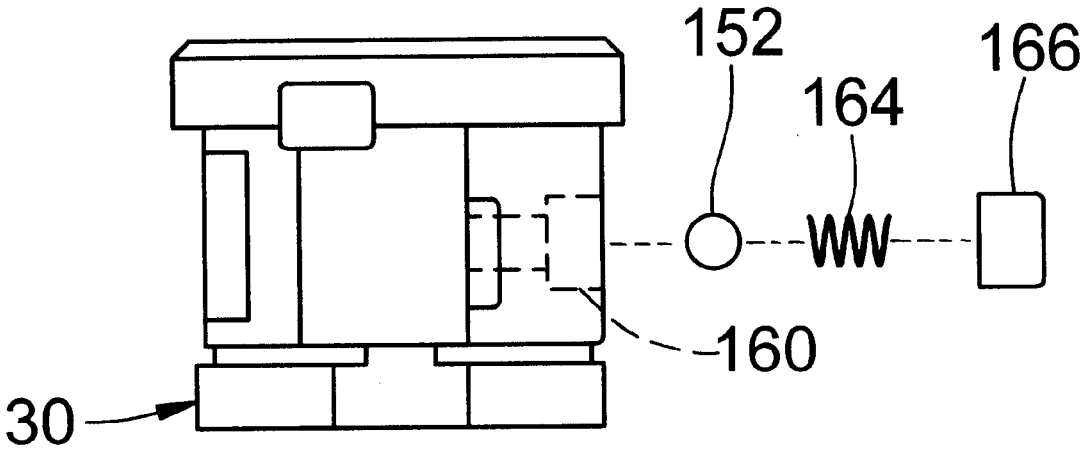
FIG. 12 is an alternate embodiment of the invention showing a modified outside housing assembly 30.

In an alternative embodiment of the present invention as shown in FIG. 12, the stop mechanism according to the invention is comprised of an opening or hole 160 formed in a sidewall of the housing 30 into which ball bearing 152 is positioned and spring biased by means of a spring 164 and retaining cap 166 into the intersecting position within opening 150 in the cylinder plug 34 as previously described. In this embodiment, upon insertion of key 130 into key way 36, the key will again intersect with a portion of ball bearing 152 to force it into engagement with a portion of the housing 30 to thereby prevent rotation of the cylinder plug 34 in a manner similar to the previous embodiment. Upon full insertion of key 130, and seating of the ball bearing within a dimpled portion 138 as previously described, rotation of the cylinder plug 34 is enabled. The seating of the ball bearing 152 within a dimpled portion 138 prevents withdrawal of the key 130 from cylinder plug 34. Accordingly, the key cannot be removed from the lock cylinder until the lock cylinder is rotated back to its original position allowing ball bearing 152 to be pushed radially outward and allowing removal of key 130. This locking feature thereby gives the electronic lock assembly the feel of a mechanical lock. As with this embodiment, it should be recognized that other suitable stop mechanisms configurations are possible to selectively prevent rotation of the cylinder plug 34 prior to retraction of the solenoid plunger 82 in the desired manner. Such alternate stop mechanisms are contemplated and within the scope of the present invention.

It should also be recognized that in both embodiments of the invention the ball bearing will prevent the key 130 from being removed from the keyway 36 after rotation of the cylinder plug 34 from its home position in operating the lock assembly as described above. Upon rotation of the cylinder plug 34, the ball bearing 152 will be seated within the dimpled portion 138 of key 130, such that 130 cannot be removed from the cylinder plug 34 until it is back in its home position, and ball bearing is moveable out of dimpled portion 138.

Whereas the invention has been shown and described with reference to particular embodiments thereof, it should be realized that there maybe many modifications, substitutions or alterations thereto, which are encompassed within the scope of the invention. The embodiments of the invention in which an exclusive property or privilege is claimed are defined as follows:

What is claimed:

1. An electronic lock assembly operable to latch a door in a door frame, the door having an interior side and an exterior side, the electronic lock assembly comprising:

a housing assembly having a first portion positionable adjacent to the interior side of the door, and a second portion positionable adjacent to the exterior side of the door, the housing assembly defining a longitudinal groove extending axially between the first portion and the second portion;

a deadbolt movable between a latched position, in which the deadbolt secures the door in the door frame, and an unlatched position, in which the door is movable with respect to the door frame;

a cylinder plug positioned in the second portion and being rotatable with respect to the housing assembly between a home position, in which the cylinder plug maintains the deadbolt in the latched position, and an unlocked position, in which the deadbolt is movable toward the unlatched position, the cylinder plug including an elongated first slot, a keyway extending through the cylinder plug and being substantially parallel to the elongated first slot, and an opening communicating with the keyway, the keyway being configured to receive a key having a recess;

an elongated rotation preventing member defining a second slot and being moveable between a first position, in which the elongated rotation preventing member lockingly engages the elongated first slot, preventing rotation of the cylinder plug toward the unlocked position, and a second position, in which he elongated rotation preventing member is moveable out of the elongated first slot upon rotation of the plug;

a spring biasing the elongated rotation preventing member toward the first position;

a solenoid assembly positioned in the first portion, the solenoid assembly including a plunger, the plunger being moveable between a third position, in which the plunger lockingly engages the second slot, holding the elongated rotation preventing member in the first position, and a fourth position, in which the plunger is spaced apart from the elongated rotation preventing member; and a stop member engagable in the recess and being movable within the opening between a fifth position, in which the stop member extends into the longitudinal groove and engages the housing assembly, preventing rotation of the cylinder plug toward the unlocked position, and a sixth position, in which the stop member extends into the keyway.

2. The electronic lock assembly according to claim 1, wherein the elongated rotation preventing niember includes a contoured point engagable in the elongated first slot.

3. The electronic lock assembly according to claim 1, wherein the stop member prevents rotation of the cylinder plug prior to full insertion of the key into the keyway.

4. The electronic lock according to claim 1, wherein the stop member is a ball bearing.

5. The electronic lock assembly according to claim 1, wherein the cylinder plug includes a data pin operable to receive a signal from the key.

6. The electronic lock assembly according to claim 4, wherein a second spring is positionable within the opening to bias the ball bearing inwardly, the second spring being retained within the opening by a retention member.

7. The electronic lock assembly according to claim 1, wherein mating of the stop member in the recess of the key will prevent removal of the key from the keyway upon rotation of the cylinder plug from the home position, until the cylinder plug returns to the home position.

8. The electronic lock assembly according to claim 1, wherein the solenoid assembly is electronically controlled, and the electronic lock assembly further comprises:

an electrical connecting board, the solenoid assembly being mounted on the electrical connecting board;

a data pin housed in the cylinder plug and operable to receive a signal from the key; and a data transfer member coupled to the connecting board and extending therefrom into electrical contact with the data pin.

9. The electronic lock assembly according to claim 8, further comprising a ground member connected to the electrical connecting board and extending therefrom to contact another portion of the lock, thereby forming an electrical ground for at least one electrical component.

10. The electronic lock assembly according to claim 8, further comprising a signaling device being operatively coupled to the connecting board.

11. The electronic lock assembly according to claim 10, wherein the signaling device is an LED.

12. The electronic lock assembly according to claim 8, further comprising a power source housed within the first portion of the housing.

13. The electronic lock assembly according to claim 12, further comprising an electrical connector coupled to the electrical connecting board for supplying power to the solenoid assembly from the power source through the electrical connecting board, the electrical connector being flexible to facilitate positioning around other components of the electronic lock assembly, the electrical connector including at least one offset to facilitate proper assembly in association with the electronic lock assembly.

14. The electronic lock assembly of claim 8, further comprising a microprocessor housed within the first portion of the housing, the microprocessor being programmed to control operation of the electronic lock assembly, and a path for signals from the data pin to the microprocessor.

15. An electronic lock assembly operable to latch a door in a door frame, the door having an interior side and an exterior side, the electronic lock assembly comprising:

a housing assembly having a first portion positionable adjacent to the interior side of the door, and a second portion positionable adjacent to the exterior side of the door, the housing assembly defining a: longitudinal groove extending axially between the first portion and the second portion;

a deadbolt movable between a latched position, in which the deadbolt secures the door in the door frame, and an unlatched position, in which the door is movable with respect to the door frame;

a cylinder plug positioned in the second portion and being rotatable with respect to the housing assembly between a home position, in which the cylinder plug maintains the deadbolt in the latched position, and an unlocked position, in which the deadbolt is movable toward the unlatched position, the cylinder plug including an elongated first slot, a keyway extending through the cylinder plug and being substantially parallel to the elongated first slot, and an opening communicating with the keyway, the keyway being configured to receive a key having a recess;

an elongated rotation preventing member defining a second slot and being moveable between a first position, in which the elongated rotation preventing member lockingly engages the elongated first slot, preventing rotation of the cylinder plug toward the unlocked position, and a second position, in which the elongated rotation preventing member is moveable out of the elongated first slot upon rotation of the plug;

a spring biasing the elongated rotation preventing member toward the first position;

a solenoid assembly positioned in the first portion and being electronically controlled, the solenoid assembly being mounted on an electrical connecting board and including:

a data pin housed in the cylinder plug and operable to receive a signal from the key;

a data transfer member coupled to the connecting board and extending therefrom into electrical contact with the data pin; and a plunger being moveable between a third position, in which the plunger lockingly engages the second slot, holding the elongated rotation preventing member in the first position, and a fourth position, in which the plunger is spaced apart from the elongated rotation preventing member; and a stop member engagable in the recess and being movable within the opening between a fifth position, in which the stop member extends into the longitudinal groove and engages the housing assembly, preventing rotation of the cylinder plug toward the unlocked position, and a sixth position, in which the stop member extends into the keyway.

16. The electronic lock assembly according to claim 15, wherein the elongated rotation preventing member includes a contoured point engagable in the elongated first slot.

17. The electronic lock assembly according to claim 15, wherein the stop member prevents rotation of the cylinder plug prior to full insertion of the key into the keyway.

18. The electronic lock assembly according to claim 15, wherein the stop member is a ball bearing, and wherein a second spring is positioned within the opening to bias the ball bearing inwardly, the second spring being retained within the opening by a retention member.

19. The electronic lock assembly according to claim 15, wherein mating of the stop member in the recess of the key will prevent removal of the key from the keyway upon rotation of the cylinder plug from the home position, until the cylinder plug returns to the home position.

* * * * *

UNITED STATES PATENT AND TRADEMARK OFFICE

CERTIFICATE OF CORRECTION

PATENT NO. : 6,591,644 B2 
DATED : July 15, 2003
INVENTOR(S) : Alan Doerr, Pete Kajuch and Cheryl Kay Koskela It is certified that error appears in the above-identified patent and that said Letters Patent is hereby corrected as shown below:

Column 7,
Line 46, “neimber” should be -- member --.

Column 8,
Line 41, delete “a:” and insert -- a --.

Signed and Sealed this

Sixth Day of January, 2004

JAMES E. ROGAN
*Director of the United States Patent and Trademark Office*